US005288033A

United States Patent [19]

Kirkpatrick

[11] Patent Number: 5,288,033

[45] Date of Patent: Feb. 22, 1994

[54] METHOD AND APPARATUS FOR CONTACT WINDING

[75] Inventor: W. Mark Kirkpatrick, Florence, S.C.

[73] Assignee: E. I. Du Pont de Nemours and Company, Wilmington, Del.

[21] Appl. No.: 968,511

[22] Filed: Oct. 29, 1992

[51] Int. Cl.[5] ..... B65H 19/26; B65H 18/16

[52] U.S. Cl. ..... 242/56 R; 242/65

[58] Field of Search ..... 242/56 R, 56 A, 568, 242/65, 66, 67.1 R

[56] References Cited

U.S. PATENT DOCUMENTS

| | | | |
|---|---|---|---|
| 2,620,993 | 12/1952 | Jeffrey, Jr. | 242/56 |
| 3,104,072 | 9/1963 | Dover et al. | 242/56.2 |
| 3,329,368 | 7/1967 | Mastriani | 242/56.2 |
| 3,365,992 | 1/1968 | Dreher | 83/614 |
| 3,386,672 | 6/1968 | Lamon et al. | 242/56 R |
| 3,556,424 | 1/1971 | Catallo et al. | 242/56 |
| 3,604,648 | 9/1971 | Schmidt | 242/56 R |
| 3,734,423 | 5/1973 | Kataoka | 242/56 |
| 3,805,652 | 4/1974 | LaLonde et al. | 83/169 |
| 4,637,567 | 1/1987 | Tanaka et al. | 242/56 |
| 4,850,545 | 7/1989 | Ballard et al. | 242/67.1 |
| 4,964,585 | 10/1990 | Negrussi | 242/56 A X |

FOREIGN PATENT DOCUMENTS 3024804 4/1982 Fed. Rep. of Germany .

*Primary Examiner*—Daniel P. Stodola
*Assistant Examiner*—John P. Darling
*Attorney, Agent, or Firm*—Thomas H. Magee

[57] ABSTRACT

A lay-on roll exerts a nip force against a roll of film winding upon a core. The lay-on roll is rotatably supported by a carriage capable of moving away from the center of the core as the wound roll of film increases in diameter. The carriage is connected to a linear bearing attached to a piston/cylinder assembly for continuously moving the carriage along a straight path colinear with a line connecting the center of the lay-on roll and the center of the core while maintaining a substantially constant nip force.

8 Claims, 3 Drawing Sheets

METHOD AND APPARATUS FOR CONTACT WINDING

BACKGROUND OF THE INVENTION

This invention pertains to a method and apparatus for contact winding wherein a lay-on roll exerts a nip force against a roll of film winding upon a core and, in particular, wherein the lay-on roll moves away from the center of the core during winding along a straight path colinear with a line connecting the center of the lay-on roll and the center of the core while maintaining a substantially constant nip force.

Apparatus for winding a thin web of material, such as paper or plastic film, in roll form on a cylindrical core is essential for the production and handling of a film web. It is especially desirable to maintain uniform pressure between the core of a windup roll and an adjacent lay-on roll for compressing film thereon in the case where a thin web of a resilient and deformable material, such as a plastic film, is to be wound. Pressure variation during winding must be minimized to ensure a uniform winding of successive layers and to obtain high quality roll formation.

U.S. Pat. No. 2,620,993 discloses apparatus appropriate for automatic web winding including a mechanism for severing a continuous web from a completed roll and transferring the severed end to an empty core of another roll. This winding apparatus has a plurality of positions for holding a winding core on the frame so that the winding of the web can be effected continuously and automatically, allowing the removal of a finished roll to take place at one position while enabling web winding to continue in another. As the web is wound onto the winding core, the core position is held stationary and a lay-on roll is held in contact with the winding roll over the complete working width at a prescribed pressure at the nip, i.e., the area of contact between the rolls. The optimum value for the pressure applied by the lay-on roll during winding is established experimentally and includes factors such as the material width as well as the mechanical properties of the film at the desired film thickness.

U.S. Pat. No. 4,850,545 discloses an apparatus for maintaining lay-on roll pressure on a winding core while a roll of film is being wound. This reference provides two means for controlling the pressure applied by the lay-on roll to the roll of the film: airsprings pivotally rotate bellcranks holding the lay-on roll to maintain fine control of the loading pressure while piston-cylinder assemblies, synchronized by a connecting shaft, horizontally index the pedestal arms mounted to the lay-on roll bellcrank assembly as the roll increases in diameter.

SUMMARY OF THE INVENTION

The present invention comprises a method and apparatus for contact winding wherein a lay-on roll exerts a nip force against a roll of film winding upon a core. The lay-on roll is rotatably supported by a carriage capable of moving away from the center of the core as the wound roll of film increases in diameter. The carriage is connected to a linear bearing attached to a piston/cylinder assembly for continuously the carriage along a straight path colinear with a line connecting the center of the lay-on roll and the center of the core while maintaining a substantially constant nip force.

DETAILED DESCRIPTION OF THE PREFERRED EMBODIMENT

Figure 1:
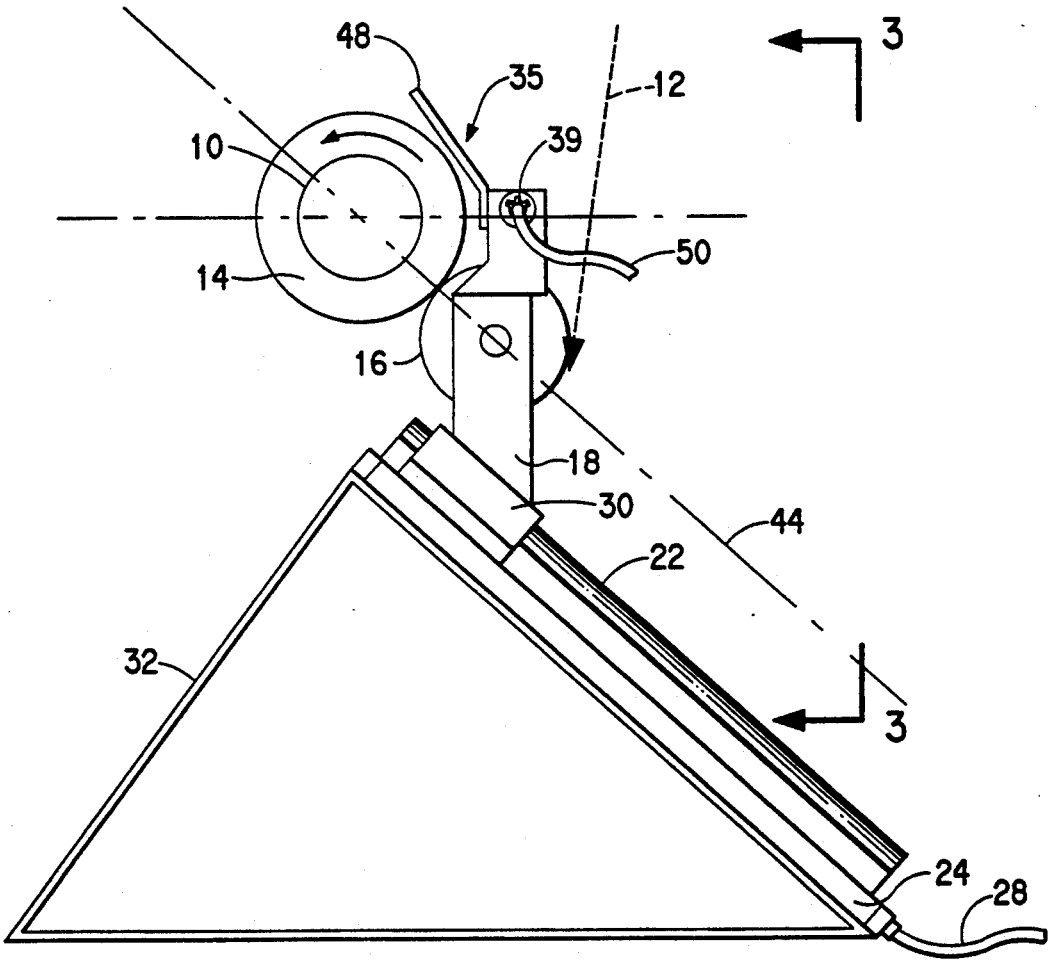
FIG. 1 is a side view of an apparatus for contact winding showing a lay-on roll in contact with film wound upon a core.

FIG. 1 shows a core 10 being wound with a plurality of layers of thin film 12 to form a film roll 14. The film 12 is pressed and laid on the core 10 by a lay-on roll 16 which exerts a substantially constant nip force during the film winding process. The lay-on roll 16 is rotatably supported on a carriage 18. The carriage 18 is attached at one end to a linear bearing 20 (shown in FIG. 2) slideably supported on a first shaft 22.

Figure 2:
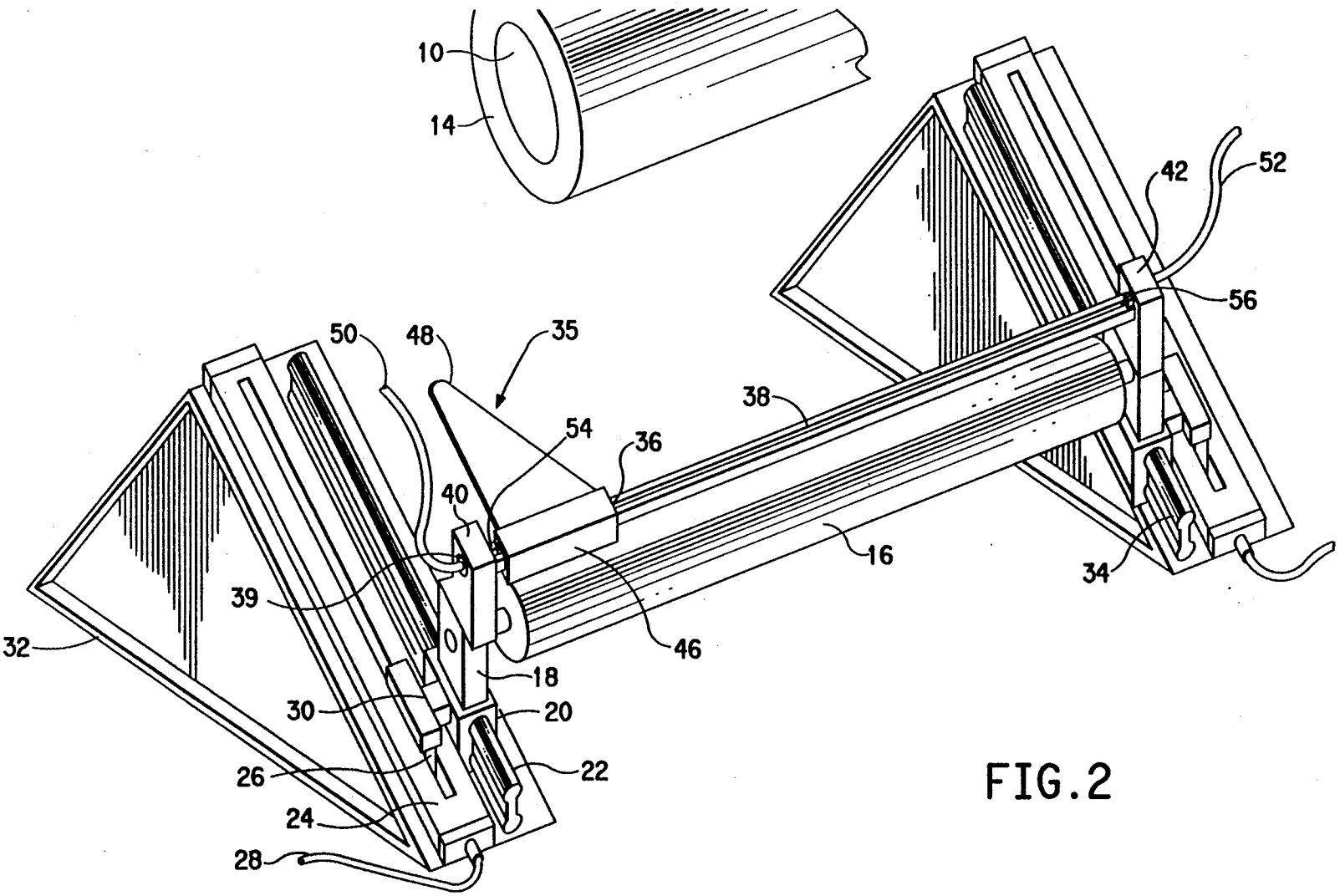
FIG. 2 is a perspective view of the contact winding apparatus illustrating rodless cylinders for positioning a carriage upon parallel shafts and urging the lay-on roll against the film roll.

FIG. 2 shows a first rodless cylinder 24 aligned parallel to the first shaft 22. The cylinder 24 contains a piston 26 which is slideably moveable within the cylinder 24 in response to air pressure supplied through a first air line 28. Linear bearings supplied by Thomson Industries, Inc. (Port Washington, N.Y.) and rodless cylinders available from either Tol-o-matic (Minneapolis, Minn.) or Origa Corporation (Elmhurst, Ill.) are suitable for use in the present apparatus.

The linear bearing 20 supporting the carriage 18 is coupled to the piston 26 in the first cylinder 24 by a coupler block 30 such that movement of the piston 26 within the first cylinder 24 provides a driving force to slideably position the linear bearing 20 along the first shaft 22 and, thereby, transmit a substantially constant nip force to the film roll 14. The coupled shaft and cylinder assembly is supported on a triangular base 32 such that the longitudinal axis of the piston 26, which applies the force urging the lay-on roll 16 in contact with the film roll 14, is parallel to a linear path connecting the centers of the lay-on roll 16 and the core 10.

The carriage 18 is similarly attached at its opposite end to a second assembly comprising the same elements disclosed above slideably supported on a second shaft 34, the second shaft 34 being aligned parallel to the first shaft 22. The lay-on roll is mounted in the carriage with a flexible bearing such that each end of the lay-on roll supported in the carriage can independently respond in the plane of FIG. 1 to an eccentricity in the film roll diameter while maintaining the substantially constant nip force applied by the piston/cylinder assembly.

As the film 12 wound on the core 10 increases in diameter, the carriage 18 and lay-on roll 16 are displaced along a straight path colinear with a line connecting the center of the lay-on roll 16 and the center of the core while maintaining a substantially constant nip force. In the present invention, it is important that the carriage 18 move continuously along a straight path colinear with a line connecting the center of the lay-on roll 16 and the center of the core 10, shown as line 44 in FIG. 1, in order to maintain a substantially constant nip force. If the movement of the carriage 18 deviates from this straight path, such as movement along an arc about a pivot point, the force applied to move the carriage 18 would have to continually change, in response to some sensing means, in order to maintain the constant nip force. It is also significant in the present invention that the first and second linear bearings are able to operate completely independent of each other so that each piston/cylinder assembly can independently move to accommodate differences in diameter at opposite ends of the film roll and, thereby, continue to maintain the constant nip force along the roll.

Figure 3:
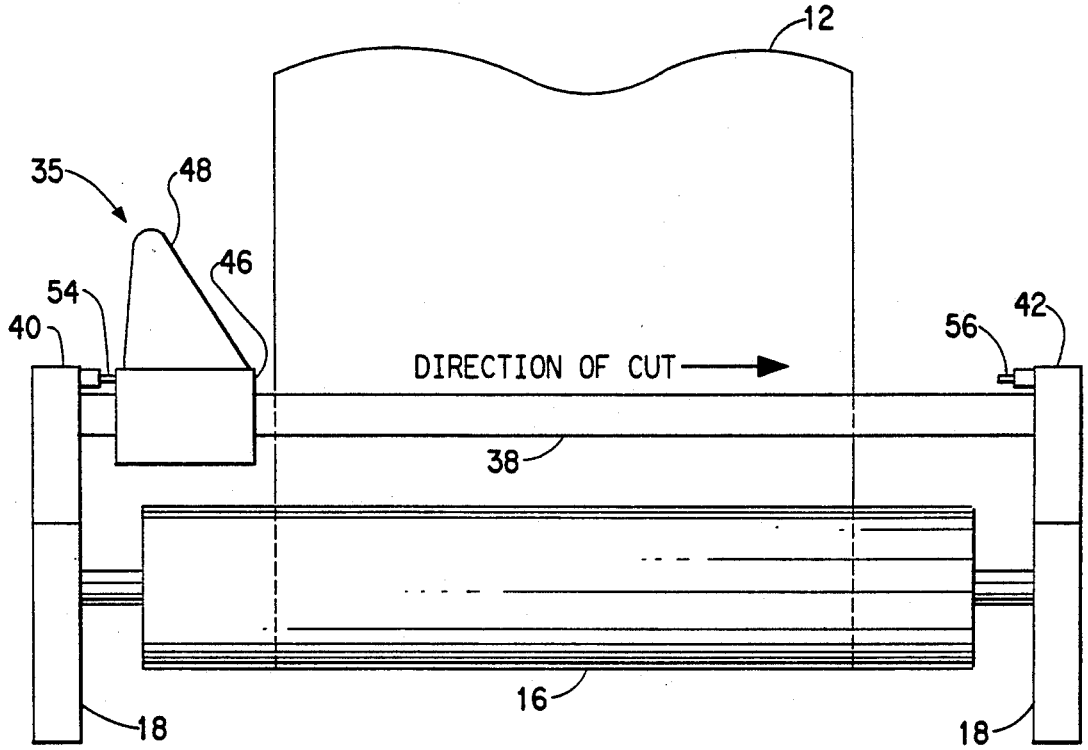
FIG. 3 is a partial elevation view taken along line 3—3 of FIG. 2 showing a flying knife assembly mounted above the lay-on roll.

FIGS. 2 and 3 show a flying knife assembly 35 for cutting the film web. The flying knife assembly 35 comprises a third piston 36 of a third rodless cylinder 38 aligned parallel to the lay-on roll 16 and attached to end supports 40 and 42 disposed, respectively, at opposite ends of the carriage 18. The third piston 36 is attached to a saddle 46 having a knife blade 48 projecting therefrom at an angle. The blade 48 is rotatably adjustable to the diameter of a new core, on which film winding is to be started, by rotating the cylinder 38 to different positions 39 at the end supports 40 and 42. To prepare for winding a new roll of film, the completed film roll is rotated on a turret (not shown) and a new core is placed in contact with the lay-on roll. The cylinder 38 is rotated such that the blade 48 will pass approximately 0.25 inches above the surface of the new core. When the third piston 36 is activated by air from air line 50, the blade 48 traverses across the flow direction of the film web from a start position to a stop position thereby cutting the web of film 12. The blade is subsequently returned to the start position by air line 52. After traversing the film web, the saddle 46 comes to rest on a shock absorber 54 or 56 located, respectfully, on the end support 40 or 42. Suitable shock absorbers are available from Enidine Corporation, Orchard Park, N.Y.

What is claimed is:

1. In an apparatus for contact winding including a lay-on roll adapted to exert a nip force against a roll of film winding on a core, said lay-on roll being rotatably supported by a carriage capable of moving away from the center of said core as the winding roll of film increases in diameter, the improvement comprising said carriage being connected to means for continuously moving said carriage along a straight path colinear with a line connecting the center of said lay-on roll and the center of said core while maintaining a substantially constant nip force, said moving means including a first linear bearing slideably supported on a first shaft oriented along the same direction as said linear path, said first linear bearing being attached to both said carriage and a first piston of a first cylinder aligned parallel to the first shaft.

2. An apparatus as defined in claim 1 wherein said first piston comprises a piston of a rodless cylinder, such that movement of said first piston within said first cylinder causes the linear bearing to move along the first shaft and, thereby, transmit a substantially constant nip force to said roll of film.

3. An apparatus as defined in claim 2 wherein said moving means further comprises a second linear bearing slideably supported on a second shaft oriented along the same direction as said linear path, said second linear bearing being attached to both said carriage and a second piston of a second rodless cylinder aligned parallel to the second shaft of said second linear bearing, said first shaft and first rodless cylinder and said second shaft and second rodless cylinder being supported, respectively, on first and second triangular base plates positioned at opposite ends of said carriage, said first and said second linear bearings adapted to operate completely independent of each other.

4. An apparatus as defined in claim 3 wherein said first and second linear bearings are attached, respectively, to said first and second pistons by first and second coupler blocks.

5. An apparatus as defined in claim 1 wherein said lay-on roll is rotatably supported by two bearings affixed, respectively, to opposite ends of said carriage.

6. An apparatus as defined in claim 1 further comprising a third piston of a third rodless cylinder aligned parallel to the lay-on roll and rotatably attached to end supports disposed, respectively, at opposite ends of said carriage, said third piston being attached to a saddle having a knife blade projecting therefrom at an angle allowing said blade to cut a web of said film when said third piston moves the blade transversely across the flow direction of said film web.

7. In a method for contact winding wherein a lay-on roll exerts a nip force against a roll of film winding on a core and moves away from the center of said core as the winding roll of film increases in diameter, said lay-on roll being rotatably supported by a carriage, the improvement in said method comprising the step of moving said carriage along a straight line colinear with a line connecting the center of said lay-on roll and the center of said core while maintaining a substantially constant nip force, said moving step being performed by sliding a first linear bearing along a supporting first shaft oriented along the same direction as said linear path, said first linear bearing being attached to both said carriage and a first piston of a first cylinder aligned parallel to said first shaft.

8. A method as defined in claim 7 wherein said first piston comprises a piston of a rodless cylinder, and wherein said moving step is performed by actuating said first piston to cause the linear bearing to move along the first shaft and, thereby, transmit a substantially constant nip force to said roll of film.

* * * * *